US006344636B1

(12) United States Patent
Kim

(10) Patent No.: US 6,344,636 B1
(45) Date of Patent: Feb. 5, 2002

(54) APPARATUS AND METHOD FOR DETECTING ABNORMAL OPERATION OF PARTS OF MICROWAVE OVEN

(75) Inventor: Seog Tae Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/686,904

(22) Filed: Oct. 12, 2000

(30) Foreign Application Priority Data

Oct. 16, 1999 (KR) ..... 99-44909

(51) Int. Cl.[7] ..... H05B 6/68

(52) U.S. Cl. ..... 219/702; 219/681; 219/757; 126/21 A

(58) Field of Search ..... 219/702, 681, 219/757, 716, 401; 99/DIG. 14, 325; 126/21 A

(56) References Cited

U.S. PATENT DOCUMENTS 4,236,055 A * 11/1980 Kaminaka ..... 219/757

FOREIGN PATENT DOCUMENTS

JP 63-99797 * 5/1988
JP 9-213471 * 8/1997
JP 10-125459 * 5/1998

* cited by examiner

*Primary Examiner*—Philip H. Leung
(74) *Attorney, Agent, or Firm*—Fleshner & Kim, LLP

(57) ABSTRACT

A method for detecting abnormal operation state of parts of a microwave oven including a memory, a plurality of heaters and cooling fans is provided, which includes the steps of extracting cooking data selected by a user from the memory, driving the cooling fan according to the extracted cooking data, determining whether or not to drive the heaters according to whether a driving current of the cooling fan is higher than a first preset current or not and detecting an abnormal state of the cooling fan, and determining whether or not to advance the cooling according to whether a driving current of the heaters is higher than a second preset current as the heaters are driven, and detecting an abnormal state of the heaters, so that the damage of parts or danger of fire of the microwave oven due to the malfunction of the parts may be prevented in advance, and the state of the microwave oven may be recognized in a remote place by using internet instead of visiting of a service member, since the malfunction may be checked by a simple key manipulation without disassembling the microwave oven.

20 Claims, 4 Drawing Sheets

APPARATUS AND METHOD FOR DETECTING ABNORMAL OPERATION OF PARTS OF MICROWAVE OVEN

FIELD OF THE INVENTION

The present invention relates to a microwave oven, and more particularly to, an apparatus and a method for detecting abnormal operation of parts of a microwave oven for preventing damage of interior parts of the microwave oven by detecting abnormal functions of parts in trouble.

DISCUSSION OF RELATED ART

FIG. 1 is a view showing a structure of heaters and a fan according to a first embodiment of related art microwave oven, and FIG. 2 is a view showing a structure of heaters and a fan according to a second embodiment of related art microwave oven.

First Embodiment

In the related art microwave oven, as shown in FIG. 1, a plurality of heaters 7, 9, 11 disposed between a power supply and a ground are connected with relays 13, 15, 17 for controlling power supply for the respective heaters 7, 8, 9 in serial, that is, the power supply for the heaters 7, 8, 9 is controlled by the on/off operation of the relays 13, 15 17.

The heaters 7, 9, 11 are connected with a plurality of cooling fans 19, 21, 23, 25 for preventing overheating due to the heat generated by the heaters when the heaters 7, 9, 11 operate. The cooling fans 19, 21, 23, 25 are also connected to relays 27, 29, 31, 33 in serial so that the operation of the cooling fans 19, 21, 23, 25 is controlled by the relays 27, 29, 31, 33.

Even though unshown, a controller part (unshown) controls the operation of the relays 13, 15, 17 for controlling the power supply for the heaters and the relays 27, 29, 31, 33 for controlling the power supply for the cooling fans. That is, the control part controls the operation of the heaters and the cooling fans according to a current cooking.

In order to prevent damage of parts due to the overheating of the heaters, a thermostat 1 is connected to the heaters. The thermostat 1 is a switch element to be turned on or off above a predetermined temperature.

Therefore, if the thermostat 1 is controlled to be turned off above a predetermined temperature, the power supply for the heaters are shut off in response to the turning off of the thermostat when the temperature is higher than the predetermined temperature by the overheating of the heaters.

Second Embodiment

In the second embodiment, the same reference symbols are utilized for the same components as shown in the first embodiment.

A plurality of heaters 7, 9, 11 are connected between a power supply and a ground in parallel. The respective heaters 7, 9, 11 are connected with relays 13, 15, 17 for controlling power supply for the respective heaters, that is, the power supply for the heaters 7, 8, 9 is controlled by the on/off operation of the relays 13, 15 17.

The heaters 7, 9, 11 are connected with a plurality of cooling fans 19, 21, 23, 25 for preventing overheating due to the heat generated by the heaters when the heaters 7, 9, 11 operate. The cooling fans 19, 21, 23, 25 are also connected to relays 27, 29, 31, 33 in serial so that the operation of the cooling fans 19, 21, 23, 25 is controlled by the relays 27, 29, 31, 33.

Even though unshown, a controller part (unshown) controls the operation of the relays 13, 15, 17 for controlling the power supply for the heaters and the relays 27, 29, 31, 33 for controlling the power supply for the cooling fans. That is, the control part controls the operation of the heaters and the cooling fans according to a current cooking.

In order to prevent damage of parts due to the overheating of the heaters, a plurality of thermostats 1, 3, 5 is connected to the heaters. The thermostats 1, 3, 5 are to be a switch element to be turned on or off above a predetermined temperature.

Therefore, if the thermostats are controlled to be turned off above a predetermined temperature, the power supply for the heaters are shut off in response to the turning off of the thermostats when the temperature is higher than the predetermined temperature by the overheating of the heaters.

Now, a process for controlling the operation of the related art heaters and the fans described as above.

The control part (unshown) determines a cooking to be currently processed, and controls operation of the heaters 7, 9, 11 according to power consumption of the cooking. If the currently processing cooking is required to drive the heater 7 only, the control part turns on the relay 13 to supply power to the heater 7.

If the relay 13 is turned on, the heater 7 is supplied with power to generate heat to perform the cooking.

If the current cooking is required to drive all the heaters 7, 9, 11, all the relays 13, 15, 17 are turned on such that the heaters 7, 9, 11 begin to operate in response to the turning on of the relays 13, 15, 17.

On the other hand, if the heater 7 is driven, the controller (unshown) drives the cooling fan 19. While all the heaters 7, 9, 11 are driven, the controller drives all the cooling fans 19, 21, 23.

That is, the cooling fans 19, 21, 23 cool the heat generated by the heaters in association with the operation of the heaters 7, 9, and 11.

The related art apparatus for controlling the heaters and the fans has, however, a disadvantage that it is impossible to detect malfunction of the heaters and the fans. Accordingly, if the heater 7 continues to operate even though the cooling fan 19 is in trouble, environmental parts of the heater 7 are damaged or fire happens due to the overheating of the heater 7.

In order to resolve this disadvantage, thermostats 1, 3, 5 are mounted around the heaters 7, 9, 11 for forcibly shutting off the power supply for the heaters 7, 9, 11 if the generated heat is higher than a predetermined temperature.

However, the construction of the related art apparatus for controlling the heaters and the fans with the thermostats 1, 3, 5 is too complicated and increase the manufacturing cost. And, such a related art apparatus still has disadvantage that it is impossible to detect the malfunction of the heaters or the fans.

Accordingly, it is required to repair the microwave oven due to the re-driving of the microwave oven since the microwave oven is controlled in a worst state by the thermostats 1, 3, 5 when the fans are in trouble, thereby decreasing the reliability of the product.

SUMMARY OF THE INVENTION

Accordingly, an object of the present invention is to solve at least the problems and disadvantages of the related art.

Another object of the present invention is to provide an apparatus and a method for detecting abnormal operation of parts of a microwave oven for preventing fire or damage of the parts possibly caused due to the abnormal operation of the parts in trouble in advance.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

To achieve the objects and in accordance with the purposes of the invention, as embodied and broadly described herein, in a microwave oven with a high voltage transformer (HVT'), an apparatus for detecting abnormal operation of parts of the microwave oven comprising: a plurality of heaters connected between a power supply and a ground potential in parallel; a plurality of relays for controlling power supply for the plurality of heaters; cooling fans to be driven in response to the operation of the heaters for cooling heat generated by the heaters; a current transformer for detecting currents used by the eaters, the cooling fan, and the high pressure transformer; and a control part for monitoring operational states of the heaters, the cooling fan and the high pressure transformer according to comparison result of a preset current amount with the current amount detected by the current transformer.

To achieve the objects and in accordance with the purposes of the invention, as embodied and broadly described herein, a method of detecting abnormal operation state of parts of a microwave oven including a memory, a plurality of heaters and a cooling fan, comprising the steps of: extracting cooking data selected by a user from the memory; driving the cooling fan according to the extracted cooking data; determining whether or not to drive the heaters according to whether a driving current of the cooling fan is higher than a first preset current or not and detecting an abnormal state of the cooling fan; and determining whether or not to advance the cooking according to whether a driving current of the heaters is higher than a second present current as the heaters are driven, and detecting an abnormal state of the heaters.

According to the present invention, the cooling fans and the heaters operate individually and abnormal operation of the cooling fans and the heaters are determined by comparison of current values detected during the operation with reference current values.

According to the present invention, the cooling fans and the heaters operate from one having a lower load in sequence and a reference current value of a load to be compared later is set by adding a current value compared previously.

According to the present invention, when a plurality of the cooling fans and the heaters operate simultaneously, the reference current value is set corresponding to the number of the operating plurality of cooling fan and the heaters.

BRIEF DESCRIPTION OF THE ATTACHED DRAWINGS

DETAILED DESCRIPTION OF THE PREFERRED EMBODIMENTS

Figure 1:
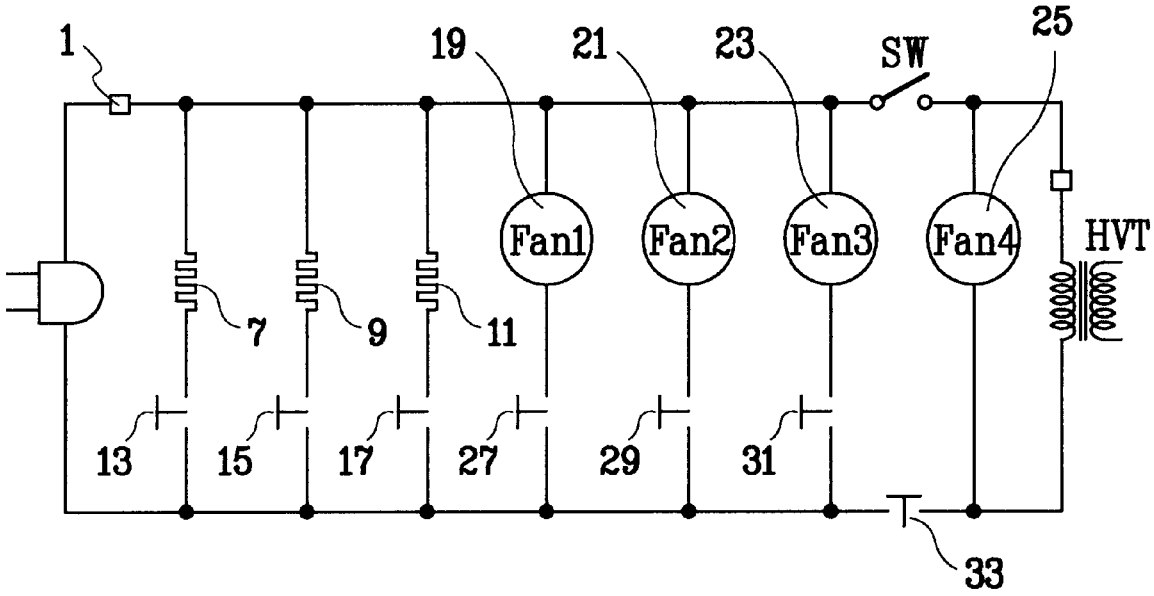
FIG.1 Prior Art
FIG. 1 is a view showing a structure for controlling heaters and fans of a microwave oven according a first embodiment of related art.
Figure 2:
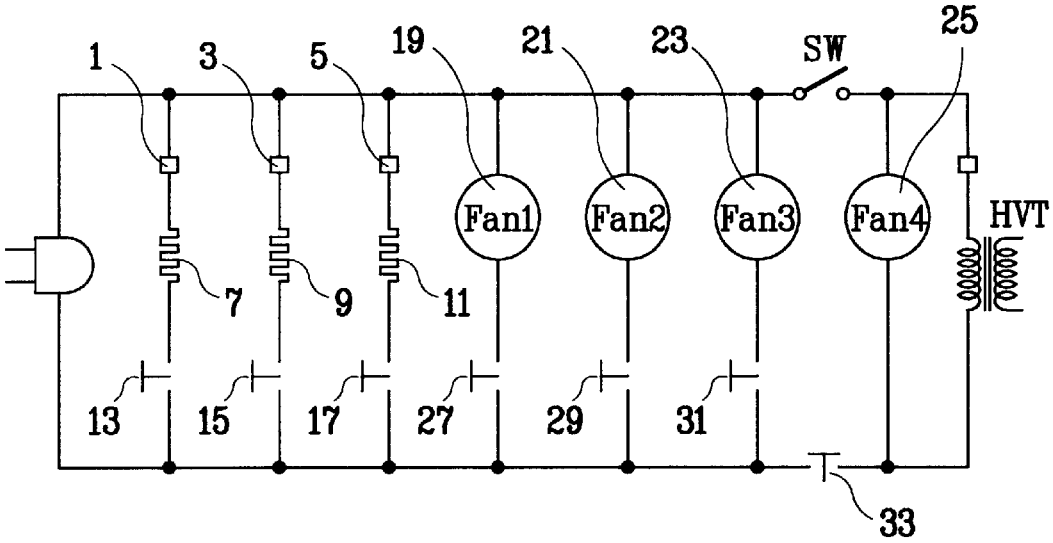
FIG.2 Prior Art
FIG. 2 is a view showing a structure for controlling heaters and fans of a microwave oven according a second embodiment of related art.
Figure 3:
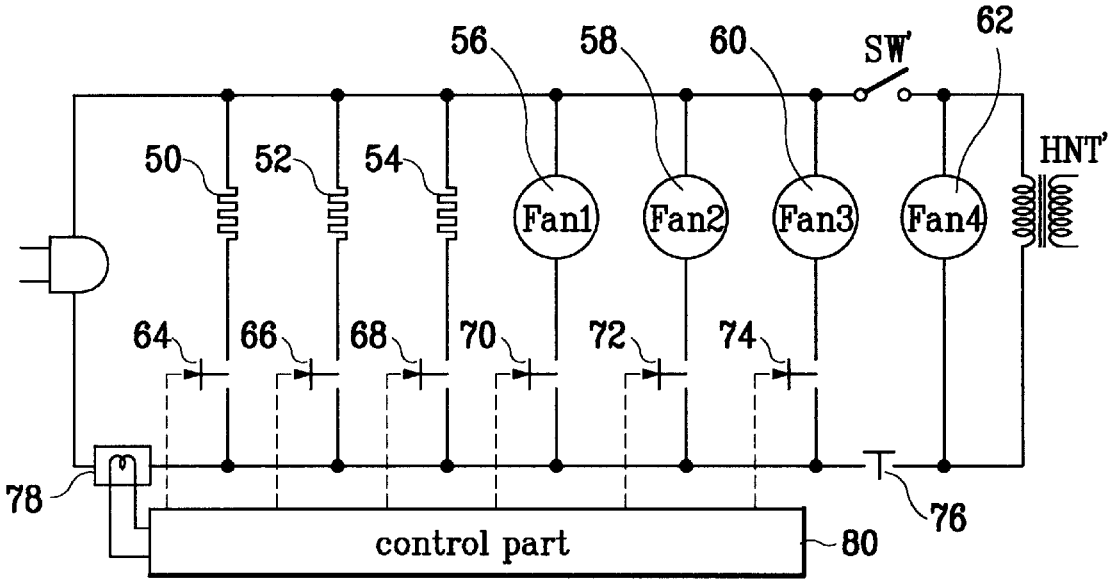
FIG. 3 is a structural view of heaters and fans of a microwave oven according to the present invention.
Figure 4:
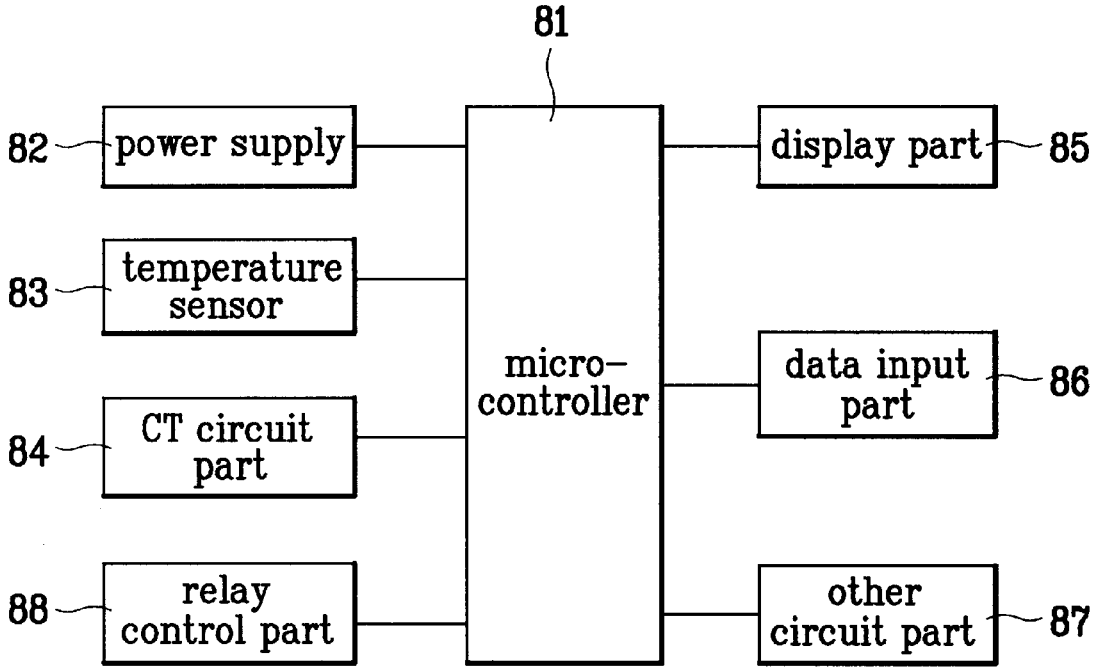
FIG. 4 is a block diagram showing an interior structure of a control part as shown in FIG. 3.

FIG. 3 is a view showing an apparatus for detecting an abnormal operation of parts of a microwave oven according to the present invention, and FIG. 4 is a detailed block diagram of a control part as shown in FIG. 3.

In an apparatus for detecting an abnormal operation of parts of a microwave oven according to the present invention, as shown in FIG. 3, a plurality of heaters 50, 52, 54 are connected between a power supply and a ground potential in parallel and the plurality of heaters 50, 52, 54 are respectively connected to relays 64, 66, 68 for controlling the power supply for the heaters.

The relays 64, 66, 68 connected to the respective heaters 50, 52, 54 are elements to control current paths of the respective heaters.

A cooling fan 56 is connected between the power supply and the ground potential for cooling heat generated by the heaters in response to the operation of the heater 50. Further, a cooling fan 58 for cooling the heater 52 and a cooling fan 60 for cooling the heater 54 are provided.

Cooling fans 56, 58, 60 are connected between the power supply and the ground potential in parallel and supplied power by relays 70, 72, 74 connected to the cooling fans 56, 58, 60 in serial.

A cooling fan 62 for cooling a high voltage transformer HVT' is connected between the power supply and the ground potential and connected to a relay 76 for controlling the power supply for the cooling fan 62 in serial.

A current transformer 78 is provided between the power supply and the ground potential for detecting current used by the heaters 50, 52, 54 and/or the cooling fans 56, 58, 60, 62 or the high voltage transformer HVT'. The current transformer 78 detects a current used current amount of the microwave oven and output the detected current amount.

The current amount detected by the current transformer 78 is applied to a control part 80 such that the control part 80 monitors the operation state of the heaters, the cooling fans and the high voltage transformer HVT' on the basis of the detected current amount.

The current amount detected by the current transformer 78 is applied to a control part 80 such that the control part 80 monitors the operation state of the heaters, the cooling fans and the high pressure transformer HVT' on the basis of the detected current amount.

The control part 80, as shown in FIG. 4, includes a power supply control part 82 for generating a rated voltage from the power supply received from a power supply input terminal to supply the rated voltage to a microcomputer 81, a temperature sensor 83 mounted at one side of a cavity (unshown) for detecting a temperature, a data input part 86 for inputting data on a cooking such as a cooking time, a cooking temperature, a kind of the cooking and the like, a display part 85 for displaying the data on a cooking corresponding to the input cooking data of the data input part 86, a relay control part 88 for generating a signal for controlling the plurality of relays 64, 66, 68, and a CT circuit part 84 for detecting a secondary part current of the current transformer 78.

The microcomputer 81 controls the on/off operation of a relay connected in serial to a heater to be driven via the relay control part 88. The microcomputer 81 discriminates a normal operation of a random heater or cooling fan according to a current value detected via the CT circuit part 84 when the random heater is driven.

The microcomputer 81 controls an advancing cooking according to a temperature detected by the temperature sensor 83 and displays a display data or an error data on the display part 85 on the basis of the input signal from the data input part 86.

That is, a malfunction of the heater may be detected regardless of the advancing of the cooling before or in the middle of the cooking, such that the error data is output on the display part 85 before or in the middle of the cooking regardless of the performance of the cooking if a heater trouble is detected.

On the other hand, the monitoring of the malfunction of a heater or a cooling fan during the cooking is carried out as follows.

First, the microcomputer 81 recognized a cooking selected by a user on the basis of the data input in the data input part 86. If the kind of the cooking is required to drive a heater, the microcomputer 81 discriminates a heater to be driven according to the kind of the cooking and turns on a relay connected to the heater to be driven in serial. The turning on operation of the relay is carried out by the relay control part 88 under the control of the microcomputer 81.

If the cooking selected by the user is required to drive the heaters 50, 52, the relay control art 88 applies a driving signal to the relays 64, 66 for turning on the relays. Then, the heaters 50, 52 connected to the relays 64, 66 are supplied power and driven.

When the heaters 50, 52 are driven, the microcomputer 81 detects the secondary part current of the current transformer 78 such that detects an abnormal operation of the heaters 50, 52 is detected if the detected current is smaller than a preset reference current.

While the cooking selected by the user is controlled by a temperature detected by the temperature sensor 83, the microcomputer 81 monitors an existence of the abnormal operation of the heaters 50, 52 from the detected current of the CT circuit part 84.

If the abnormal operation of the heaters is detected by such a monitoring operation, the microcomputer displays the troubled heater in the display part 85.

Accordingly, the microcomputer 81 presets the secondary part current level of the current transformer which may monitor the existence of abnormal operation of the heaters according to the kinds of the cooking when distinguishing the heaters to be driven according to the kinds of the cooking. And the microcomputer 81 monitors the operation of the heaters to operate by changing the reference current for the heaters.

Now, a method for detecting an abnormal operation of parts of a microwave oven according to the present invention constructed as above will be described in more detail.

Figure 5:
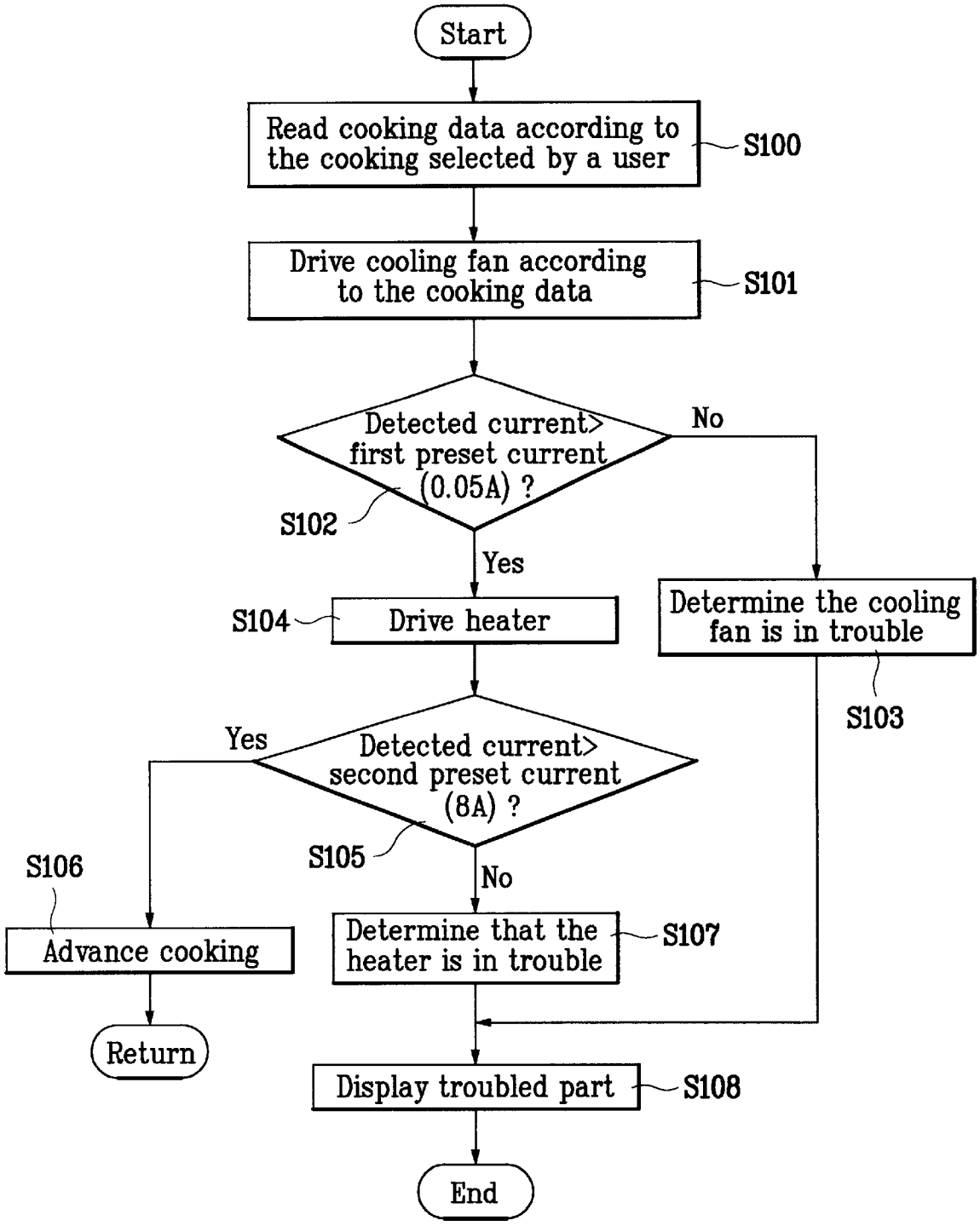
FIG. 5 is a flow chart showing a method for detecting an abnormal operation of parts of a microwave oven according to the present invention.

FIG. 5 is a flow chart showing the method for detecting an abnormal operation of parts of a microwave oven according to the present invention.

The control part 80 recognizes a cooking to be currently advanced and reads cooking data of the cooking to be performed from a memory(unshown) (S100). The control part 80 recognizes driving currents of the heaters and the cooling fans from the read cooking data.

For example, if the driving current for the respective heaters 50, 52, 54 is 10 A, the driving current for the respective cooling fans 56, 58, 60, 62 is 0.08 A, and the current of the high pressure transformer HVT' is 8 A, the control part 80 determines a size of the driving current according to the cooking data read from the memory.

If the cooking requires only the operation of the heater 50, the control part 80 recognizes the driving current 0.08 A for the cooling fan 56 and the driving current 10 A of the heater 50 (A first case).

As shown in the first case, if the cooking requires the operation of the heater 50 only, the control part 80 drives the cooling fan by turning on the relay RY4 70 (S101).

The current transformer 78 detects a current for driving the cooling fan 56 and inputs the detected current value to the control part 80. The control part 80 determines whether the detected current value is larger than a first preset current 0.05 A or not (S102).

Wherein, the current value 0.05 A preset as a reference value for monitoring an abnormal operation of the cooling fan 56 is lower than the current value 0.08 A detected during a real operation state of the cooling fan 56. That is, the reference current value is preset lower than a rated current for preventing malfunction due to the deviation of the product assembly even though the real current value is detected 0.08 A in a normal operation of the cooling fan 56.

As result of the determination (S102), if the detected current value is larger than the first preset current value 0.05 A, the cooling fan 56 is determined to be in a normal operation such that the relay RY1 is turned on for driving the heater (S104).

That is, if the relay 64 is turned on, the heater 50 is supplied with power and begins to operate.

At this time, the current transformer 78 detects a system current and output the detected system current to the control part 80. The control part 80 determines whether the detected current value is larger than a second preset current 8 A or not (S105).

The current value 8 A preset as a reference value for monitoring an abnormal operation of the heater 50 is lower than the current value 10 A detected during a real operation state of the heater 50, even though the current value more than 10 A is to be detected actually since the cooling fan 56 is already in operation (S101) when the heater 50 operates in step S104. However, the reference current value is preset to 8 A for preventing malfunction due to the deviation of the product assembly.

As a result of the determination (S105), if the detected current value is larger than the second preset current value 8 A, the heater 50 is determined to be in a normal operation such that the cooking is controlled to be advanced(S106).

On the other hand, as a result of the determination(S105), if the detected current value is smaller than the second preset current value 8 A, then the heater 50 is determined to be in an abnormal operation such that an error data due to the heater trouble is displayed (S107–S18).

As a result of the determination (S102), if the detected current value is smaller than the first preset current value 0.05 A, then the cooling fan 56 is determined to be in an abnormal operation and an error data is displayed(S103, S108).

The trouble of the heater 50 or the cooling fan 56 is output by using a buzzer or the display part in step (S124).

In the meantime, if the cooling requires operation of all the heaters 50, 52, 54, the control part 80 recognized the driving current 0.18 A for the cooling fans 56, 58, 60 and the driving current 30 A for the heaters 50, 52, 54 (A second case).

The control part 80 controls operations of parts of which load is smaller for monitoring normal operation of the respective parts. Since it is impossible to monitor an abnormal operation by individually operating all the respective parts in a real cooling even though it is possible in a testing step, the current transformer 78 detects the system current by operating the parts having a smaller load.

The first case is an monitoring of the abnormal operation of the heater 50 and the cooling fan 56 when the cooking requires the operation of the single heater 50 only, and this may be applied for other heaters or cooling fans to be operated individually.

However, in the second case when the cooking requires the operation of the plurality of heaters 50, 52, 54, the reference values for monitoring the abnormal operation of the heaters and the cooling fans have to be changed.

That is, if the cooking requires the operation of all the heaters 50, 52, 54, the control part 80 recognizes the driving current 0.18 A for the cooling fans 56, 58, 60 and the driving current 30 A for the heaters 50, 52, 54.

The control part 80 sets a reference value with an approximate value, which may be detected by the driving of the cooling fans, 56, 58, 60 in step S104. For example, the reference value is preferably 0.15 A.

In step S106, it is preferable to set the reference value with an approximate value, which may be detected by the driving of the heaters, 50, 52, 54. For example, the reference value is preferably 25 A.

In this case, since the cooling fans are already in operation in step S106, it is preferable to consider a load current due to the driving of the cooling fans into the reference value.

In addition, in step S102, it is also possible to monitor an abnormal operation of the high voltage transformer HVT' by recognizing the rated current of the high voltage transformer HVT'.

In the present invention, since the current flows as the relays 64, 66, 68, 70, 72, 74, 76 operate, the current is detected by the current transformer 78 and utilized as a basic signal for monitoring an abnormal operation of the respective parts.

The control part 80 recognizes the current value detected by the current transformer 78 and compares the detected current with a particular current value of parts to be energized by the operation of the respective relay for determining an abnormal operation of the parts according to a difference between the compared current values.

In the present invention, it is possible to monitor an abnormal operation of the respective parts by operating the relays continuously one by one, and a plurality of parts by operating a part having a lower load in sequence.

As described hereinabove, the apparatus and the method for detecting an abnormal operation of parts of a microwave oven according to the present invention have advantages to prevent damage and fire of products due to the abnormal operation of the parts.

Further, the present invention has an advantage that the malfunction may be checked by a simple manipulation of keys without disassembling the product at a remote plate by using internet instead of a service member's visiting.

The forgoing embodiments are merely exemplary and are not to construe as limiting the present invention. The present teachings can be readily applied to other types of apparatuses or methods. The description of the present invention is intended to be illustrative, and not to limit the scope of the claims. Many alternatives, modifications, and variations will be apparent to those skilled in the art.

What is claimed is:

1. In a microwave oven with a high voltage transformer (HVT'), an apparatus for detecting abnormal operation of parts of the microwave oven comprising:

a plurality of heaters connected between a power supply and a ground potential in parallel;

a plurality of relays for controlling the power supply for the plurality of heaters, wherein each heater is in parallel with each other and has one of the plurality of relays in communication therewith;

cooling fans driven in response to the operation of the heaters;

a current transformer for detecting currents used by the heaters, the cooling fans, and the high voltage transformer; and a control part for controlling and monitoring the operational states of the heaters, the cooling fans and the high voltage transformer according to the amount of current detected by the current transformer.

2. The apparatus of claim 1, wherein the control part comprises:

a power supply control part for receiving power supply from a power supply input terminal and generating a rated voltage to supply;

a temperature sensor mounted at one side in a cavity for detecting temperature;

a data input part for inputting cooking data according to a kind of cooking;

a memory for storing the cooking data;

a relay control part for generating signals for controlling the plurality of relays;

a CT circuit part for detecting current of a secondary part of the current transformer;

a microcomputer for comparing an input current level detected by the CT circuit part with a preset reference current to detect an abnormal operation of the heaters or the cooling fan; and a display part for displaying data input from the data input part and displaying the abnormal state of the heaters or the cooling fan according to a control signal of the microcomputer.

3. A method for detecting abnormal operation state of parts of a microwave oven including a memory, a plurality of heaters and a cooling fan, comprising:

extracting cooking data selected by a user from the memory;

driving the cooling fan according to the extracted cooking data;

measuring a driving current of the cooling fan;

detecting an abnormal state of the cooling fan by determining whether the driving current of the cooling fan is higher than a first current preset value;

driving one or more of the plurality of heaters if an abnormal state of the cooling fans is not detected;

measuring a driving current of the driven heaters;

detecting an abnormal state of the heaters by determining whether the driving current of the heaters is higher than a second current preset value; and advancing the cooking if an abnormal state of the heaters is not detected.

4. The method of claim 3, wherein the detecting an abnormal state of the cooling fan comprises:

driving the heaters if the driving current of the cooling fan is higher than the first current preset value;

determining that the cooling fan is malfunctioning if the driving current of the cooling fan is lower than the first current preset value; and displaying a message regarding the malfunction of the cooling fan to a display part.

5. The method of claim 4, wherein the first current preset value is about 0.05 A.

6. The method of claim 3, wherein the detecting an abnormal state of the heaters comprises:

advancing the cooking if the driving current of the heaters is higher than the second current preset value;

determining that the heaters are malfunctioning if the driving current of the heaters is lower than the first current preset value; and displaying a message regarding the malfunction of the heaters to a display part.

7. The method of claim 6, wherein the second current preset value is about 8 A.

8. The method of claim 3, wherein additional cooling fans and heaters are activated when activated cooling fans and heaters having a lower load are activated.

9. The method of claim 8, wherein a reference current value of a load is set by adding current values compared previously when the cooling fans and the heaters are operating.

10. The method of claim 3, wherein when a plurality of the cooling fans and the heaters operate concurrently, the reference current value is set corresponding to the number of operating cooling fans and heaters.

11. An apparatus for detecting abnormal operation of parts of a microwave oven, comprising:

a plurality of cooling fans in electrical communication with a power supply and a ground potential in parallel;

a current transformer in electrical communication with the power supply and the ground potential, wherein the current transformer detects the level of current between the power supply and the ground potential; and a controller for receiving current level information from the current transformer, comparing the current level to a first preset value, wherein the first preset value corresponds to the current level value of the cooling fans when they are properly functioning, and wherein the controller also determines whether the current level has a higher value than the first preset value and runs the cooling fan if the current level has a higher value than the first preset value.

12. The apparatus of claim 11, further comprising:

a plurality of heaters connected between the power supply and the ground potential in parallel, wherein the control part also compares the current level to a second preset value, wherein the second preset value corresponds to the current level value of the heaters when they are properly functioning.

13. A microwave oven with a plurality of heaters and a plurality of cooling fans, wherein the improvement comprises:

a current transformer for detecting current levels used by the heaters and cooling fans; and a controller for comparing the detected current levels to a first preset value corresponding to a current level value of the cooling fans when they are functioning properly and controlling the cooling fans based upon the comparison.

14. The apparatus of claim 13, wherein the controller also compares the detected current levels to a second preset value corresponding to a current level value of the heaters when they are functioning properly and controls the heaters based on the comparison.

15. A method for detecting abnormal operation of parts of a microwave oven, comprising:

driving at least one cooling fan;

measuring the driving current of the at least one cooling fan;

determining whether the driving current of the at least one cooling fan is abnormal by comparing the measured driving current with a first preset value of a driving current when the at least one cooling fan is operating properly; and continuing to drive the at least one cooling fan if the at least one cooling fan is operating properly.

16. The method of claim 15, further comprising:

driving at least one heater if the at least one cooling fan is operating properly;

measuring the driving current of the at least one heater;

determining whether the driving current of the at least one heater is abnormal by comparing the measured driving current of the heater with a second preset value of a driving current when the at least one heater is operating properly; and continuing to drive the at least one heater if the at least one heater is operating properly.

17. The method of claim 16, further comprising:

inputting cooking data into a control part to determine if one or more cooling fans and/or one or more heaters are driven.

18. The method of claim 16, further comprising:

stopping the driving of the at least one cooling fan or the at least one heater if either is not operating properly; and displaying an error message on a display panel if the at least one cooling fan or the at least one heater is not operating properly.

19. The method of claim 18, wherein a first error message is displayed if the at least one cooling fan is not working properly and a second error message is displayed if the at least one heater is not working properly.

20. The method of claim 16, wherein the start of the driving of the at least one cooling fan occurs before the start of the driving of the at least one heater, wherein if the cooling fan is not working properly the at least one cooling fan and the at least one heater are not driven, and wherein the at least one cooling fan must be operating properly before the at least one heater is driven.

* * * * *